US012357144B2

(12) United States Patent
Czarnecki et al.

(10) Patent No.: US 12,357,144 B2
(45) Date of Patent: Jul. 15, 2025

(54) DISH DRYING SYSTEM WITH ADSORBENT MATERIAL REGENERATION

(71) Applicant: WHIRLPOOL CORPORATION, Benton Harbor, MI (US)

(72) Inventors: Philip J. Czarnecki, Saugatuck, MI (US); Muhammad Khizar, St. Joseph, MI (US); Mateusz M. Wolowicz, Olawa County (PL)

(73) Assignee: Whirlpool Corporation

( * ) Notice: Subject to any disclaimer, the term of this patent is extended or adjusted under 35 U.S.C. 154(b) by 274 days.

(21) Appl. No.: 18/312,470

(22) Filed: May 4, 2023

(65) Prior Publication Data

US 2023/0270312 A1 Aug. 31, 2023

Related U.S. Application Data

(62) Division of application No. 17/386,987, filed on Jul. 28, 2021, now Pat. No. 11,812,911.

(51) Int. Cl.
*A47L 15/00* (2006.01)

(52) U.S. Cl.
CPC ..... *A47L 15/0042* (2013.01); *A47L 15/0034* (2013.01)

(58) Field of Classification Search
None
See application file for complete search history.

(56) References Cited

U.S. PATENT DOCUMENTS

| | | | |
|---|---|---|---|
| 8,758,525 | B2 | 6/2014 | Kim |
| 8,869,424 | B2 | 10/2014 | Hermann et al. |
| 9,161,676 | B2 | 10/2015 | Grunewald |
| 2008/0283099 | A1 | 11/2008 | Peukert et al. |
| 2011/0186094 | A1 | 8/2011 | Hong |
| 2012/0055519 | A1 | 3/2012 | Hong et al. |
| 2017/0319045 | A1 | 11/2017 | Wu et al. |
| 2020/0281437 | A1 | 9/2020 | Fallert et al. |

FOREIGN PATENT DOCUMENTS

| | | |
|---|---|---|
| EP | 2 120 672 B1 | 2/2012 |
| EP | 2 465 406 B1 | 6/2012 |
| EP | 2 248 456 B1 | 6/2013 |

(Continued)

OTHER PUBLICATIONS

EP Extended Search Report for EP Application No. 22 18 7105, dated Dec. 14, 2022.

*Primary Examiner* — Rita P Adhlakha
(74) *Attorney, Agent, or Firm* — Brooks Kushman P.C.

(57) ABSTRACT

A dishwasher includes a housing having walls defining a tub having an outlet and inlet for humid air to flow out from and into the tub, respectively. A drying system contacts at least one wall of the tub. The drying system includes an inlet conduit fluidly connected to the outlet and an outlet conduit fluidly connected to the inlet with the inlet conduit and the outlet conduit forming an inverted V-shaped air circuit defining an airflow path therethrough. The drying system also includes at least one adsorbent component having an adsorbent material positioned along the airflow path, and at least one gate check valve blocking airflow from the tub to the adsorbent material during a wash cycle. The adsorbent material is regenerated via heat transfer through the at least one wall from the tub during a wash cycle when the gate check valve is closed.

20 Claims, 4 Drawing Sheets

(56) References Cited

FOREIGN PATENT DOCUMENTS

| | | | |
|---|---|---|---|
| IT | T020 110 841 | A1 | 3/2013 |
| WO | 2013/050468 | A1 | 4/2013 |
| WO | 2017/195057 | A1 | 11/2017 |
| WO | 2019/192882 | A1 | 10/2019 |
| WO | 2019/215628 | A1 | 11/2019 |

DISH DRYING SYSTEM WITH ADSORBENT MATERIAL REGENERATION

The present application is a division of U.S. patent application Ser. No. 17/386,987, filed Jul. 28, 2021, now U.S. Pat. No. 11,812,911, issued on Nov. 14, 2023, the disclosure of which is hereby incorporated in its entirety by reference herein.

TECHNICAL FIELD

The present application is directed to a drying system for a home appliance, and more particularly, improved regeneration of adsorbent material in the drying system.

BACKGROUND

Dishwashers have been and are becoming more and more standard in homes. Dishwashers may provide for automatic washing of a load, including for example, dishes and other cookware arranged on various racks within the tub of the dishwasher. Existing dishwashers include various conventional drying systems (e.g., with condensers, vents, fans, etc.) for drying the load. However, the conventional drying systems may have certain performance drawbacks including, for example, not completely drying the load, taking a longer time for drying, or allowing humid air to condense back onto the dishes and cookware within the tub. Thus, not only do consumers place importance on the speed and performance of the dishwasher, but energy efficiency of the drying capabilities is an important feature of dishwashers as well.

SUMMARY

According to one or more embodiments, a dishwasher includes a housing having walls defining a tub having an outlet for humid air to flow out from the tub, an inlet for dry air to flow into the tub, and a door for closing the tub to an exterior environment, and a drying system contacting at least one wall of the tub. The drying system includes an inlet conduit fluidly connected to the outlet and an outlet conduit fluidly connected to the inlet with the inlet conduit and the outlet conduit forming an inverted V-shaped air circuit defining an airflow path therethrough. The drying system also includes at least one adsorbent component having an adsorbent material positioned along the airflow path, and at least one gate check valve blocking airflow from the tub to the adsorbent material during a wash cycle. The adsorbent material is regenerated via heat transfer through the at least one wall from the tub during a wash cycle when the gate check valve is closed.

According to at least one embodiment, the adsorbent material may be positioned against a side wall or a top wall of the tub. In one or more embodiments, each of the inlet conduit and the outlet conduit include a corresponding adsorbent component positioned against a side wall of the walls. In at least one embodiment, during a dry cycle, the gate check valve may be open such that humid air can flow through the drying system to be dried via the adsorbent component and dry air be returned to the tub via the inlet. In at least one embodiment, the dishwasher may further include a fan disposed in the inverted V-shaped air circuit to facilitate the airflow through the drying system. In at least one further embodiment, the fan may be disposed between the inlet conduit and the outlet conduit. In one or more embodiments, the at least one gate check valve includes a first gate in the inlet conduit and a second gate in the outlet conduit, with both the first and second gates being actuated by a single actuator. According to at least one embodiment, at least one of the inlet conduit and the outlet conduit may drain water formed during regeneration of the adsorbent by gravity to the tub. In at least one other embodiment, the drying system may further include at least one drain positioned to remove water formed during regeneration of the adsorbent by gravity.

According to one or more embodiments, a dishwasher includes a housing having walls defining a tub having an outlet for humid air to flow out from the tub, an inlet for dry air to flow into the tub, and a door for closing the tub to an exterior environment; and a drying system contacting at least one wall of the tub. The drying system includes an inlet conduit fluidly connected to the outlet, an outlet conduit fluidly connected to the inlet with the inlet conduit and the outlet conduit forming an inverted V-shaped air circuit defining an airflow path therethrough. The drying system also includes at least one adsorbent component with an adsorbent material within the airflow path and positioned to receive heat transferred through the at least one wall from the tub during a wash cycle to regenerate the adsorbent material and release water from the adsorbent material to be drained from the drying system during the wash cycle. The drying system also includes at least one gate check valve including a first gate positioned upstream of the adsorbent material in the inlet conduit and a second gate positioned downstream of the adsorbent material in the outlet conduit, the first and second gates having a closed position during the wash cycle blocking airflow from the tub and an open position during a drying cycle allowing air to flow through the drying system and back to the tub.

According to at least one embodiment, the first and second gates may be actuated by a single actuator such that the first and second gates are both in the closed position during the wash cycle and both in the open position during the dry cycle. In at least one embodiment, the drying system may further include at least one drain positioned to remove water formed during regeneration of the adsorbent by gravity. In one or more embodiments, the adsorbent component may be positioned on a top wall of the walls of the dishwasher, and the inlet conduit and outlet conduit are at least partially positioned on a side wall of the tub. In at least one embodiment the at least one adsorbent component may be positioned on a side wall of the tub. In at least one further embodiment, each of the inlet conduit and the outlet conduit may include a corresponding adsorbent component positioned against the side wall on either side of the inverted V-shaped air circuit. In at least one embodiment, the dishwasher may further include a fan disposed in the inverted V-shaped air circuit to facilitate the airflow through the drying system.

According to one or more embodiments, a method of operating a dishwasher includes running a wash cycle to clean dishes loaded into a tub, initiating a dry cycle to supply hot air to the tub to dry the dishes and form hot humid air, and opening a gate check valve upon the initiation to unblock the hot humid air from entering a drying system. Upon opening the gate check valve, the method includes flowing the hot humid air into the drying system to contact at least one adsorbent material positioned within a conduit of the drying system and contacting at least one tub wall of the tub to absorb moisture from the hot humid air and form a dry air stream for supply to the tub. The method further includes, during a subsequent wash cycle, regenerating the adsorbent material via heat transfer through the at least one tub wall such that water released from the adsorbent material is drained from the drying system prior to the subsequent dry cycle.

According to at least one embodiment, flowing the hot humid air into the drying system may include actuating a fan disposed in the drying system upon initiation of the dry cycle to facilitate air flow through the drying system. In at least one embodiment, the tub wall is a side tub wall or a top tub wall. In one or more embodiments, opening the gate check valve may include opening both a first gate in an inlet conduit of the conduits and a second gate in an outlet conduit of the conduits via a single actuator.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

According to one or more embodiments, a dishwasher includes a drying system to draw moisture out of the humid air being circulated through the dishwasher and return dry air back to the tub to facilitate drying of dishes in the tub of the dishwasher. The drying system includes an adsorbent material along the air circuit which is positioned against the tub wall or tub ceiling such that heat from the tub during the wash cycle can regenerate (i.e., release water from) the adsorbent material, with the drained water being returned to the tub for draining at the end of the wash cycle. The adsorbent material is blocked from airflow by a gate check valve that spans the air circuit such that a single actuator opens the gates to allow airflow during the drying cycle. In certain embodiments, cooling devices can be used to increase the adsorption potential of the adsorbent material during the drying cycle.

Figure 1:
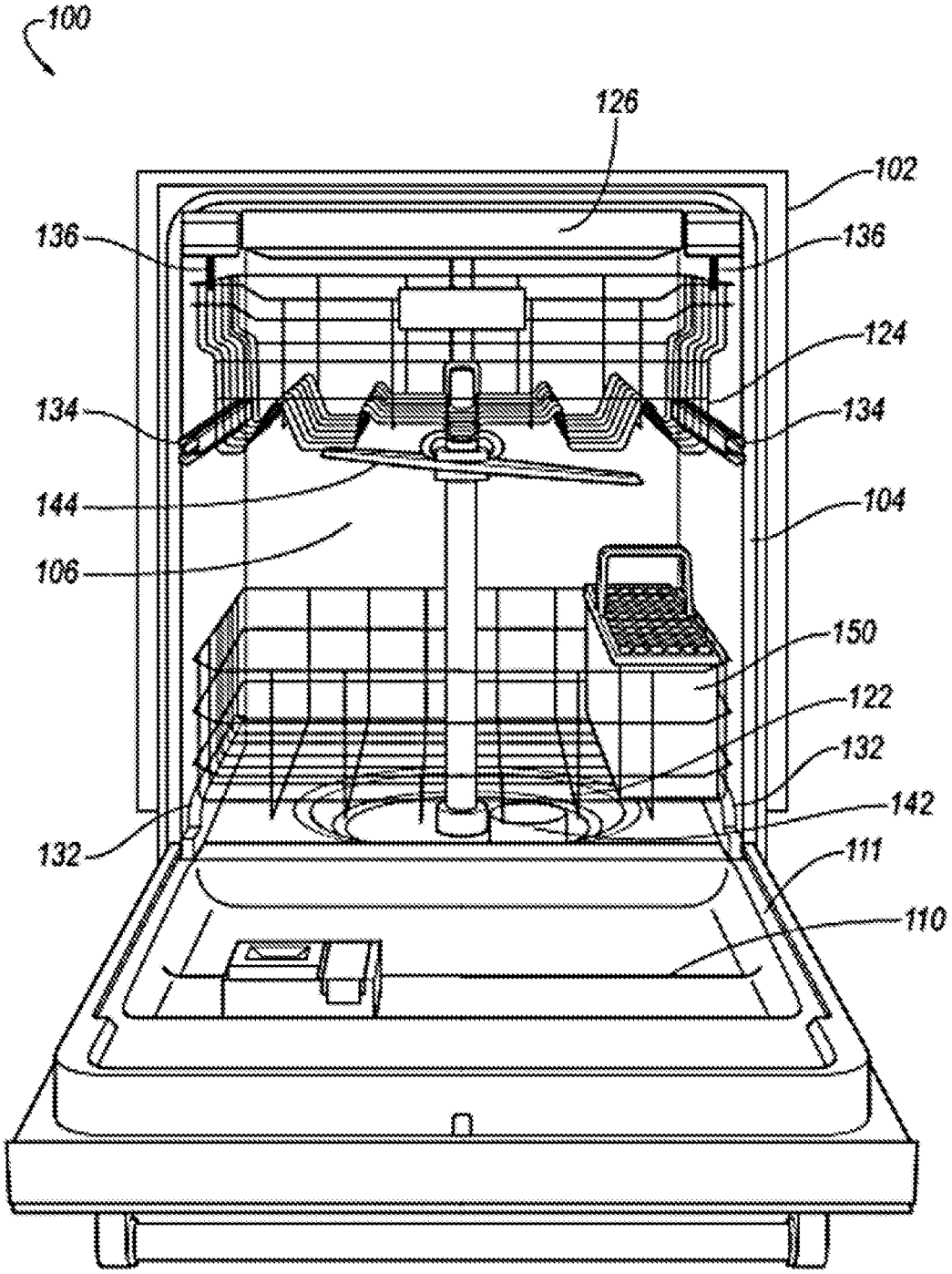
FIG. 1 is a front view of a dishwasher, according to an embodiment.

FIG. 1 illustrates an example front perspective view of a dishwasher 100 in accordance with one example embodiment. The dishwasher 100 may be an automated appliance configured to clean kitchen equipment placed within the dishwasher 100. The kitchen equipment may include tableware such as, for example, dishes, glassware, cutlery and other utensils, as well as food preparation equipment such as, for example, pots and pans, slicers, presses, and peelers. To perform the cleaning, the kitchen equipment is placed on racks 122, 124 inside a tub 104 of the dishwasher 100. A door assembly 110 is closed to form a watertight seal with the tub 104 from an exterior environment. Washing liquid and rinsing liquid is propelled from jets onto the kitchen equipment to clean dirt, grease, and other contaminants off the kitchen equipment. Though the examples described herein are generally related to in-home and personal use dishwashers, the same concepts may be applicable to commercial dishwashers as well.

The dishwasher 100 may include a frame 102 defining the exterior walls of the dishwasher 100. The frame 102 may be configured to interface with components exterior to the dishwasher 100 for installation, such as cabinets, countertops, floors, etc. The frame 102 may include a top, left side, right side, back, and bottom.

The tub 104 may define a hollow cavity or interior of the dishwasher for washing dishes. The tub 104 may define an open-face, or access opening 106 with walls at the top, left side, right side, back and bottom. A chassis (not individually labeled) may be arranged between the frame 102 and the tub 104 to maintain the tub 104 within the frame. The chassis may support the tub 104 and allow for maintaining space between the frame 102 and the tub 104.

A door assembly 110 may be arranged at a front of the dishwasher 100. The door assembly 110 may be attached to the dishwasher at the bottom front edge of the frame 102 and may be hinged thereat to move between open and closed positions. In the closed position, the door assembly 110 may seal the tub 104 at the access opening 106. In the open position, the cavity may be accessible via the access opening. In another example, the door assembly 110 may operate as a drawer that can be slidably extended outward from the front of the dishwasher 100 to move into the open position, and slidably retracted back into the dishwasher 100 to the closed position to seal the tub 104.

The tub 104 may house at least one dish rack. In the example shown in FIG. 1, the dishwasher 100 includes a first dish rack 122 and a second dish rack 124. It should be noted that while two dish racks are shown, this is only one example, and dishwashers 100 with more or fewer dish racks are possible. For instance, a dishwasher 100 may include a single rack or three or more racks.

Regardless of quantity or arrangement, the dish racks 122, 124 may be designed to hold the kitchen equipment in place for cleaning by the dishwasher 100. In many examples the dish racks 122, 124 are wire frame racks that allow for the flow of liquid within the tub 104. Although racks 122, 124 made of plastic, other materials are possible. The dish racks 122, 124 may generally include tines or other projections to allow the kitchen equipment to be washed to be held in a spaced apart relationship, such that the washing liquid and rinsing liquid can be projected onto the exposed kitchen equipment surfaces for cleaning these surfaces.

The racks are generally adapted to move between a retracted wash position within the tub 104 and an extended position outside the tub 104 for loading and unloading of the kitchen equipment to be washed. The racks typically include wheels or rollers for rolling movement along tracks or guides to the retracted and extended positions. In the illustrated example, the first rack 122 includes rollers or wheels that cooperate with a first track rail 132 formed at the bottom wall of the tub 104. A door track 111 may be arranged on the dishwasher door of the door assembly 110 as shown to allow the first rack to be rolled into an extended position when the door of the door assembly 110 is open. The second rack 124 is generally mounted within the tub 104 along a pair of second support rails 134 that cooperate with rollers associated with the side walls of the tub 104. Alternatively, the second rack 124 may be connected to a telescoping rail that allows the second rack to be extended out of the tub area when the door of the door assembly 110 is open. Thus, as shown the first and second racks 122, 124 may be movable along their respective track rails 132, 134 to allow the respective racks 122, 124 to be slidable in and out of the access opening 106. A third rack or tray 126 may also be arranged on and above one or more of the racks 122, 124. In the illustrated example, the third rack 126 is arranged above the second rack 124, but other configurations are possible, such as a single rack with a tray, or multiple racks each with a third rack 126, or one rack with multiple trays. As with the dish racks 122, 124, the third rack 126 is configured to receive kitchen equipment for washing. In one non-limiting example, the third rack 126 may be designed to hold kitchen equipment such as cutlery or knives that, due to their dimensions, are more difficult to hold in a fixed spaced apart arrangement within the dish racks 122, 124 themselves.

The dishwasher 100 may also include a spray system for spraying liquid within the tub 104 during a wash cycle. In an example wash cycle, washing liquid including soap may first be sprayed onto the kitchen equipment, and then once washed, rinsing liquid without soap may then be sprayed onto the kitchen equipment. The spray system may include various jets for providing the liquid onto the surfaces of dishes during the automated washing and rinsing operations. The spray system may include a bottom sprayer 142, middle sprayer 144, and a top sprayer (not shown). In some examples, one or more of the sprayers are positioned at fixed locations within the tub 104. In other examples, one or more of the sprayers may be rotating spray arms with various nozzles configured to spray water onto the dishes maintained on the rack for cleaning. For instance, water jets on the spray arm may be angled so the water sprays out of the spray arms at an angle (e.g., ~45 degrees off the vertical) thereby causing the spray arms to rotate due to the pressure of the exiting water.

During loading, a user may open the door assembly 110 into the open position, pull the racks 122, 124 from the tub 104, and load the kitchen equipment onto the racks 122, 124. Once completed, the user may push the racks back into the tub 104, move the door assembly 110 back to the closed position, and initiate the wash cycle. Once the wash cycle has been completed, the user may again open the door assembly 110 to remove the cleaned kitchen equipment from the racks.

Before the user opens the door assembly to remove the cleaned kitchen equipment, the dishwasher undergoes a dry cycle after the wash cycle is complete. The dry cycle is implemented by a drying system 200, a portion of the drying system 200 is shown and described with reference to FIGS. 2-7. The drying system 200 of the dishwasher 100 promotes water evaporation from the kitchen equipment (or, interchangeably, the load) positioned on the racks 122, 124 after the wash cycle has concluded, and prevents humid air from condensing back onto the load. The evaporation aspect of the drying system can be achieved by either heating the load with hot water in the final rinse phase of the wash cycle, or by heating the load and air with an internal or external heater (not shown) during the drying cycle. In certain embodiments described herein, the drying system may include components to heat the load and air with an internal or external heater during the drying phase. The load and air heating can be achieved in a variety of ways, for example, by condensing the humidity onto the tub walls for draining; removing humid air by venting via natural convection (e.g., a door opening system); forcing the humid air out of the system via a fan; or absorbing the humidity from the air in the tub with an adsorbent, or desiccant, material.

According to one or more example embodiments, the drying system for the dishwasher 100 includes a drying system 200 positioned such that an adsorbent material can be regenerated without any external heat sources. The drying system 200 thus not only facilitates the drying performance and regeneration of the adsorbent, but improves the energy efficiency of the dishwasher 100. Various embodiments of the drying system 200 will be shared with reference to the Figures. Generally, the drying system 200, 300 of FIGS. 2-3 do not require separate cooling of the adsorbent material, and the drying system of 400, 500 of FIGS. 4-5 incorporates cooling of the adsorbent material into the drying system. With reference to the figures like numerals are used to designate like structure throughout the drawings.

Figure 2:
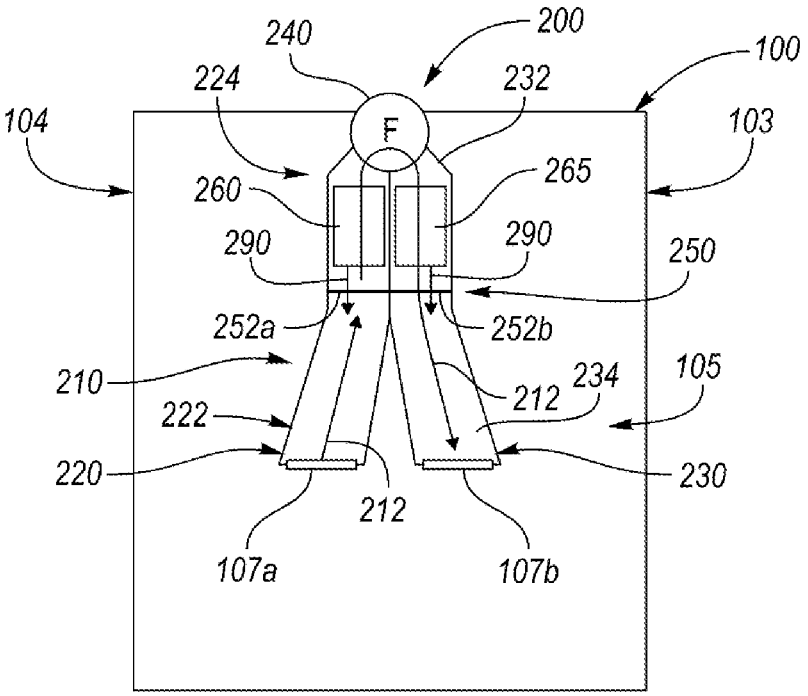
FIG. 2 is a schematic side view of a drying system of a dishwasher, according to an embodiment.

Referring to FIG. 2, the exterior of the tub 104 of the dishwasher 100 is shown with a drying system 200, according to an embodiment. The dishwasher 100 is schematically shown without the frame 102 with only the relevant components of the drying system 200 shown, which is not intended to be limiting, as the dishwasher 100 includes other components and features for operation that have been removed to more clearly show the drying system 200. As such, an external surface 103 of the tub 104 of the dishwasher 100 is shown in FIG. 2 with the drying system 200 positioned on the external surface 103, and more specifically, on a tub side wall 105 of the tub 104. The drying system 200 has a generally inverted V-shaped air circuit 210 formed by an inlet conduit 220 and an outlet conduit 230. The tub side wall 105 may define one or more tub outlets 107*a* fluidly connecting the inlet conduit 220, and one or more tub inlets 107*b* for fluidly connecting the outlet conduit 230 to allow airflow 212 to flow into the air circuit 210. The cross-section of each conduit 320, 330 may be shaped according to the contours of the external surface 103 of the tub 104.

A fan 240 is positioned at the vertical apex of the air circuit 210, between the inlet conduit 220 and the outlet conduit 230 for facilitating the airflow 212 to flow into the inlet conduit 220, through the air circuit 210, and out through outlet conduit 230. Although a single fan 240 is shown at the apex of the air circuit 210, multiple fans 240 may be positioned throughout the air circuit 210 as based on various designs and desired airflow through the drying system 200, and the depiction of a single fan 240 is not intended to be limiting. Moreover, the fan 240, in certain embodiments, may be positioned closer to the tub outlet 107*a* or closer to the tub inlet 107*b*, or at either end of the inlet conduit 220 or outlet conduit 230, and the position at the vertical apex is an example of where the fan 240 may be located in one embodiment, and is not intended to restrict the position of the fan 240 in other embodiments.

In the embodiment shown in FIG. 2., the inlet conduit 220 has an inlet upstream side 222 defined at the outlet 107*a*, and an inlet downstream side 224 defined at the fan 240. The outlet conduit 230 has an outlet upstream side 232 defined at the fan 240 and an outlet downstream side 234 at the tub inlet 107*b*. The drying system 200 further includes a gate check valve 250 with gates 252*a*, 252*b* that block airflow 212 through both the inlet conduit 220 and the outlet conduit 230, respectively. The gate check valve 250 is activated by an actuator (not shown) (e.g., a motor, linear actuator, such as a wax actuator, solenoid, or similar suitable actuator) to rotate and/or move the gates 252*a*, 252*b* from obstructing the airflow 212 through the inlet conduit 220 and the outlet conduit 230, respectively. In certain embodiments, the gate check valve 250 may be biased in the closed position (e.g., by a spring) such that the gate check valve 250 is actuated by exerting a force on the gate check valve 250. For example, air pressure from the fan can open the gate check valve 250. The gate check valve 250 may be a unitary system where the gates 252*a*, 252*b* are actuated by a single mechanism for both the inlet conduit 220 and the outlet conduit 230 based on the inverted V-shape of the air circuit 210, thus a single actuator may be used in certain embodiments for activating the gates 252*a*, 252*b*. The gate check valve 250 and gates 252*a*, 252*b* provide a barrier to airflow 212 from moving downstream through the air circuit 210 during the wash cycle, and are open to allow airflow 212 therethrough during the dry cycle. In certain embodiments, the second gate 252*b* may be open to allow drainage during regeneration (i.e., during the subsequent wash cycle), and as such, in some examples, the gate check valve operates the first and second gates independently.

The drying system 200 further includes a first adsorbent component 260 positioned in the air circuit 210 downstream of the gate 252*a* in the inlet conduit 220, and upstream of the fan 240. The drying system 200 also includes a second adsorbent component 265 positioned in the air circuit 210 downstream of the fan 240 in the outlet conduit 230, and upstream of the gate 252*b*. In certain embodiments, the first adsorbent component 260 and the second adsorbent component 265 may be symmetrically disposed in either conduit of the V-shaped air circuit 210 as based on the Y-axis centerline of the air circuit 210. In other embodiments, the first adsorbent component 260 and the second adsorbent component 265 may be asymmetrically positioned within their respective conduits as based on the airflow 212 profile through the conduits in order to maximize adsorption. The positioning of the first and second adsorbent components 260, 265 against the tub 104 allows for heat from the interior of the tub 104 to conduct through the tub side wall 105 and to the first and second adsorbent components 260, 265 to regenerate (i.e., release moisture in the form of water from) the adsorbent material during the wash cycle, when the gate check valve 250 is closed such that airflow 212 is restricted from contacting the adsorbent components 260, 265. Based on the air circuit 210 shape and the position of the air circuit 210 on the tub side wall 105, the water (shown by arrows 290) from the adsorbent components 260, 265 can be released and drained via gravity to the tub inlet 107*b* or tub outlet 107*a* via the outlet conduit 230 or the inlet conduit 220, respectively, to be released into the tub 104 and to the sump (not shown) at the end of the wash cycle.

Each of the first and second adsorbent components 260, 265 includes an adsorbent material that facilitates drying of the humid airflow 212 through the air circuit 210 of the drying system 200. The adsorbent material may be any suitable adsorbent material, such as, but not limited to a sorbent nanomaterial. The nanomaterial may be a sponge-like nanomaterial, or other suitable nanomaterial capable of regeneration and reducing the energy burden required to absorb and desorb water vapor from the airflow 212 through the drying system 200. Thus, the adsorbent material within the adsorbent components 260, 265 provide energy-efficient humidity management, enable more efficient desiccant operation, and allow for atmospheric water extraction designs to be implemented. The nanomaterial adsorbents function like traditional desiccants, but use less energy to regenerate (i.e., eject their water vapor load) at a much lower temperature than traditional desiccants. For example, the regeneration temperature of the adsorbent material in certain embodiments may be 30 to 65° C. in some embodiments, 35 to 63° C. in other embodiments, and 40 to 60° C. in yet other embodiments, whereas in conventional desiccants, the regeneration temperature may be up to 200° C., and upwards of 65° C. The adsorbent material of each adsorbent component 260, 265 may be capable of storing up to 300 mL of water, which can be released upon regeneration for draining. The lower regeneration requirements of the adsorbent material results in improved energy-efficiency and lower temperature exhaust as external heaters are not needed in the drying system 200, and the dry air can be circulated back into the tub 104 for additional drying and moisture extraction. As such, the adsorbent components 260, 265 each may have a regeneration temperature of 30 to 65° C. which is reached via conductive heat transfer from the interior of the tub 104 during a wash cycle. As such, the adsorbent material is heated via heat from the tub 104, without any additional heating components for regenerating the adsorbent material, and dry air can be circulated back into the tub 104 via the outlet conduit 230.

Referring again to FIG. 2, during the drying cycle, the gate check valve 250 opens the gates 252*a*, 252*b*, and the airflow 212 enters the air circuit 210 as hot humid airflow 212 from the tub 104 from tub outlet 107*a*, flowing into the inlet conduit 220 via being drawn in by the fan 240. The airflow 212 passes through the first adsorbent component 260 such that moisture is removed from the airflow 212. The fan 240 continues to move the airflow 212 through the air circuit 210 and into the outlet conduit 230, where the airflow 212 passes through the second adsorbent component 265 such that remaining moisture is removed from the airflow 212. The airflow 212 continues to flow through the outlet conduit 230, past open gate 252*b*, to be returned to the tub 104 via tub inlet 107*b*. The adsorbent material of the adsorbent components 260, 265 is then regenerated during the following wash cycle when the temperature increases inside the tub 104 for heat transfer to the adsorbent components 260, 265, such that water is drained from the adsorbent components 260, 265 prior to the drying cycle and activation of the gate check valve 250 of the drying system 200.

In one or more embodiments, the drying system 200 includes a drain (not shown) for draining water from the regenerated adsorbent. In certain embodiments, the drain is incorporated with the gate check valve 250 allows water to flow therethrough (as shown via arrows 290). In other embodiments, the drain is positioned elsewhere in the drying system 200 and configured to remove the water formed during regeneration of the adsorbent from the drying system. For example, the drain may be incorporated with adjacent to the adsorbent components such that the water is removed upon regeneration. However, the water may be drained at any suitable point during the wash and/or dry cycles via the drain as based on its position within the drying system. In embodiments where the drain is incorporated in the gate check valve 250, the water may be drained during regeneration during the following wash cycle into the tub. In other embodiments, the drain may flow the water out from the drying system directly to an outlet, where it may, in certain embodiments, join water expelled from the tub to the outlet.

Figure 3:
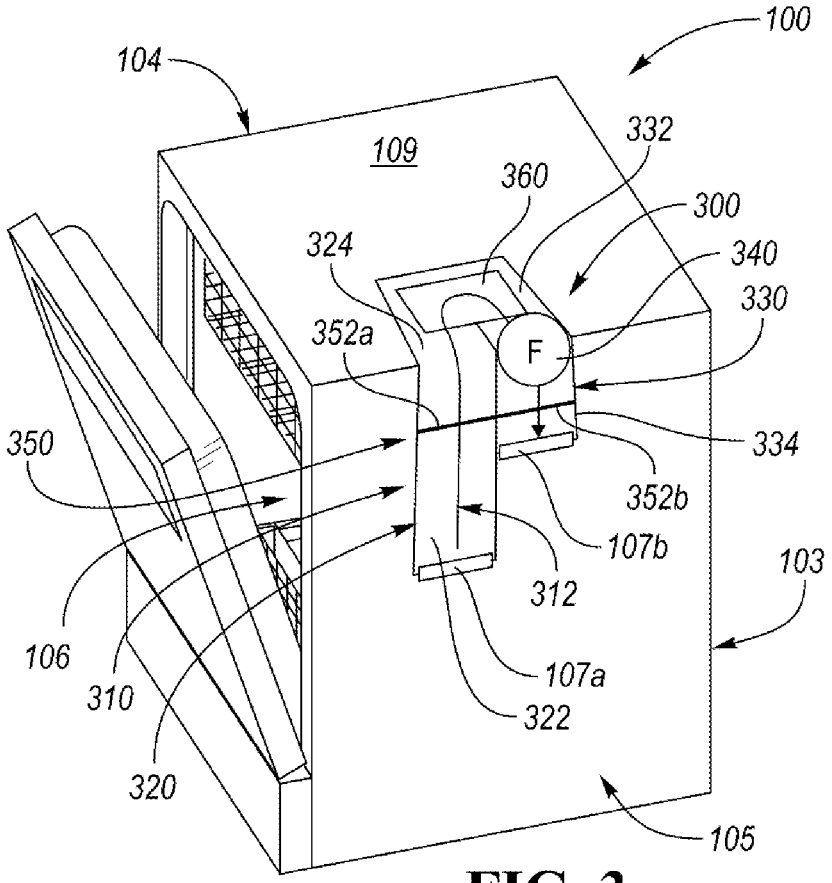
FIG. 3 is a schematic perspective view of a drying system of a dishwasher, according to another embodiment.

Referring to FIG. 3 the exterior of the tub 104 of the dishwasher 100 is shown with a drying system 300, according to another embodiment. The dishwasher 100 is schematically shown without the frame 102 with only the relevant components of the drying system 300 shown, which is not intended to be limiting, as the dishwasher 100 includes other components and features for operation that have been removed to more clearly show the drying system 300. As such, an external surface 103 of the tub 104 of the dishwasher 100 is shown in FIG. 3 with the drying system 300 positioned on the external surface 103. More specifically, in the embodiment shown in FIG. 3, the drying system 300 is positioned on both the tub side wall 105 of the tub 104 and on a tub top wall 109. The tub top wall 109 is generally, in most dishwashers 100, the hottest surface during wash cycles, and can be conductive to heat. As such, the drying system 300 has a generally inverted V-shaped air circuit 310 formed by an inlet conduit 320 and an outlet conduit 330, with the air circuit 310 spanning both the tub side wall 105 and the tub top wall 109 of the external surface 103 of the tub 104. The drying system 300 includes an adsorbent component 360 positioned against the top tub wall 109 within the air circuit 310, which allows for regeneration of the adsorbent material in the adsorbent component 360 via heat transferred through the tub top wall 109. The tub side wall 105 may define one or more tub outlets 107*a* fluidly connecting the inlet conduit 320, and one or more tub inlets 107*b* for fluidly connecting the outlet conduit 330 to allow airflow 312 to flow into the air circuit 310. Although shown as asymmetrical lengths in FIG. 3, the position of the tub outlet 107*a*, tub inlet 107*b*, and the lengths of the inlet conduit 320 and outlet conduit 330 may be positioned at a similar level along the vertical height such that the inverted V-shaped air circuit 310 is generally symmetrical across the Y-axis of the tub 104. The inlet conduit 320 thus begins on the tub side wall 105, and ends at the tub top wall 109, and the outlet conduit 330 begins on the tub top wall 109, and ends on the tub side wall 105. The cross-section of each conduit 320, 330 may be shaped according to the contours of the external surface 103 of the tub 104.

A fan 340 is positioned in the outlet conduit 330 of the air circuit 310, between the adsorbent component 360 and the tub inlet 107*b* for facilitating the airflow 312 into the inlet conduit 320, through the air circuit 310, and out through outlet conduit 330. Although a single fan 340 is shown downstream of the adsorbent component 360, the fan 340 may be positioned anywhere within the air circuit 310 for facilitating circulation of the airflow 312 therethrough, and in some embodiments, multiple fans 340 may be positioned throughout the air circuit 310 as based on various designs and desired airflow through the drying system 300, and the depiction of a single fan 340 is not intended to be limiting. Moreover, the fan 340, in certain embodiments, may be positioned closer to the tub outlet 107*a* or closer to the tub inlet 107*b*, and the position downstream of the adsorbent component 360 is an example of where the fan 340 may be located in one embodiment, and is not intended to restrict the position of the fan 340 in other embodiments.

In the embodiment shown in FIG. 3., the inlet conduit 320 has an inlet upstream side 322 defined at the tub outlet 107*a*, and an inlet downstream side 324 defined at the adsorbent component 360 (corresponding to the apex of the V-shaped air circuit 310). The outlet conduit 330 has an outlet upstream side 332 defined at the adsorbent component 360 and an outlet downstream side 334 at the tub inlet 107*b*. Thus, the fan 340 is shown positioned downstream of the adsorbent component 360 in the outlet conduit 330. The drying system 300 further includes a gate check valve 350 with gates 352*a*, 352*b* that block airflow 312 through both the inlet conduit 320 and the outlet conduit 330, respectively. The gate check valve 350 and gates 352*a*, 352*b* are positioned against the tub side wall 105 of the tub 104, and configured to block airflow 312 to the adsorbent component 360 positioned against the tub top wall 109. The gate check valve 350 is activated by an actuator (not shown) to rotate and/or move the gates 352*a*, 352*b* from obstructing the airflow 312 through the inlet conduit 320 and the outlet conduit 330, respectively. The gate check valve 350 may be similarly actuated as discussed above with respect to gate check valve 250. The gate check valve 350 may be a unitary system where the gates 352*a*, 352*b* are actuated by a single mechanism for both the inlet conduit 320 and the outlet conduit 330 based on the inverted V-shape of the air circuit 310 (whether the air circuit 310 is asymmetrical as shown in FIG. 3 with the inlet conduit 320 being longer, asymmetrical with the outlet conduit 330 being longer, or symmetrical), thus a single actuator may be used in certain embodiments for activating the gates 352*a*, 352*b*. The gate check valve 350 closes gates 352*a*, 352*b* during the wash cycle, and opens the gates 352*a*, 352*b* to allow airflow 212 therethrough during the dry cycle. In certain embodiments, the second gate 352*b* may be open to allow drainage during regeneration, and as such, in some examples, the gate check valve operates the first and second gates independently.

Referring again to FIG. 3, as previously described, the adsorbent component 360 is positioned within the air circuit 310 and against the tub top wall 109 such that heat from the tub 104 is conducted through the tub top wall 109 into the drying system 300 and the adsorbent component 360 to regenerate (i.e., release moisture in the form of water from) the adsorbent material during the wash cycle, when the gate check valve 350 is closed such that airflow 312 is restricted from contacting the adsorbent components 360. In some embodiments, based on the shape, contouring, and position of the air circuit 310 on the external surface 103 of the tub 104, the water released from the adsorbent component 360 during regeneration is drained via gravity to the tub inlet 107*b* or tub outlet 107*a* via the outlet conduit 330 or the inlet conduit 320, respectively, to be released into the tub 104 and to the sump (not shown) at the end of the wash cycle. In other embodiments, a drain may be fluidly connected to an outlet stream from the dishwasher 100 for drainage of the regenerated water, such that the water from regeneration is drained during the wash cycle through the drain, and the drain is a different outlet than the outlets to the tub 104.

The adsorbent material of the adsorbent component 360 may be a suitable adsorbent material as described with respect to the drying system 200. As such, the adsorbent component 360 may reach the regeneration temperature of 30 to 65° C. which is reached via conductive heat transfer from the interior of the tub 104 during a wash cycle. As such, the adsorbent material is heated via heat from the tub 104, without any additional heating components for regenerating the adsorbent material.

Referring again to FIG. 3, during the drying cycle, the gate check valve 350 opens the gates 352*a*, 352*b*, and the airflow 312 enters the air circuit 310 as hot humid airflow 312 from the tub 104 from tub outlet 107*a*, flowing into the inlet conduit 320 via being drawn in by the fan 340. The airflow 312 flows upward along the external surface 103 of the tub 104, curving to the tub top wall 109, and passing through the adsorbent component 360 such that moisture is removed from the airflow 312. The fan 340 continues to move the airflow 312 through the air circuit 310 and into the outlet conduit 330, past open gate 352*b*, to be returned to the tub 104 via tub inlet 107*b*. The adsorbent material of the adsorbent component 360 is then regenerated during the following wash cycle when the temperature increases inside the tub 104 for heat transfer to the adsorbent component 360, such that water is drained from the adsorbent component 360 prior to the drying cycle and activation of the gate check valve 350 of the drying system 300.

Figure 4:
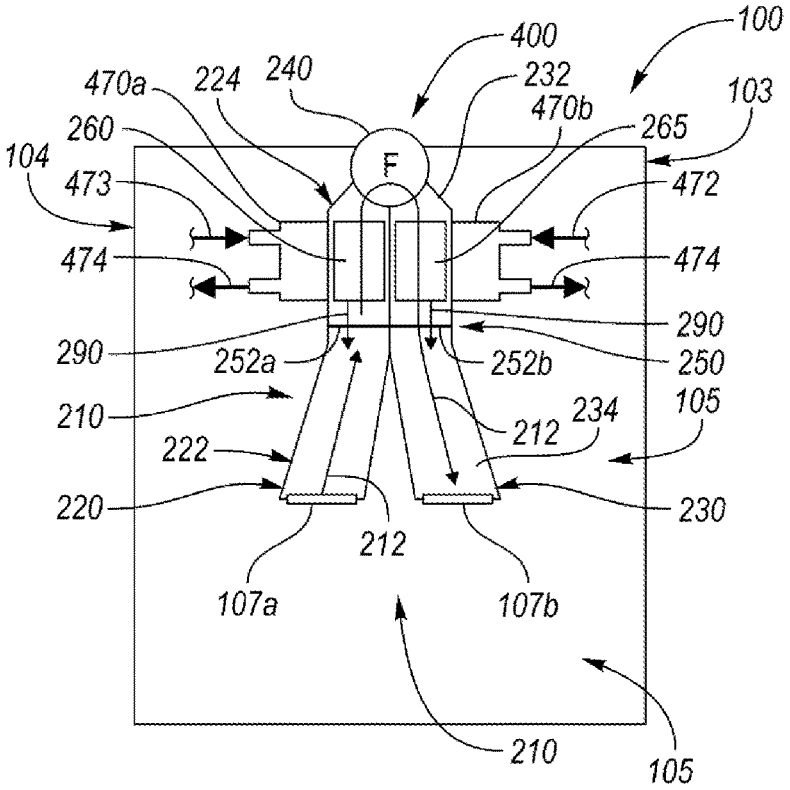
FIG. 4 is a schematic side view of a drying system of a dishwasher, according to yet another embodiment.

Referring to FIG. 4, the dishwasher 100 is shown with a drying system 400 according to another embodiment. The drying system 400 includes similar components as drying system 200 having an inverted V-shaped air circuit 210 positioned against the tub side wall 105, and the reference numerals of the drying system 200 are referenced in FIG. 4. The drying system 400 further includes a cooling mechanism such as coolers 470*a*, 470*b* corresponding to the adsorbent components 260, 265 respectively. The coolers 470*a*, 470*b* are positioned adjacent the adsorbent components 260, 265, and in contact with the walls of the air circuit 210 to cool the adsorbent material during the drying cycle such that the adsorption potential can be increased. Although two coolers 470*a*, 470*b* are shown in FIG. 4, one or more coolers may be used as based on the desired design of the drying system 400. For example, in some embodiments, although not shown, a single cooler may be disposed in the channel between the inlet conduit 220 and the outlet conduit 230 (within the inner portion of the inverted V). The coolers 470*a*, 470*b* are supplied with a coolant, such as water, which flows through the coolers 470*a*, 470*b* via coolant supply lines 472 and coolant outlet lines 474. The coolant may be any suitable temperature to enhance adsorption of the adsorbent material, and in some embodiments, may be about 15° C.

Figure 5:
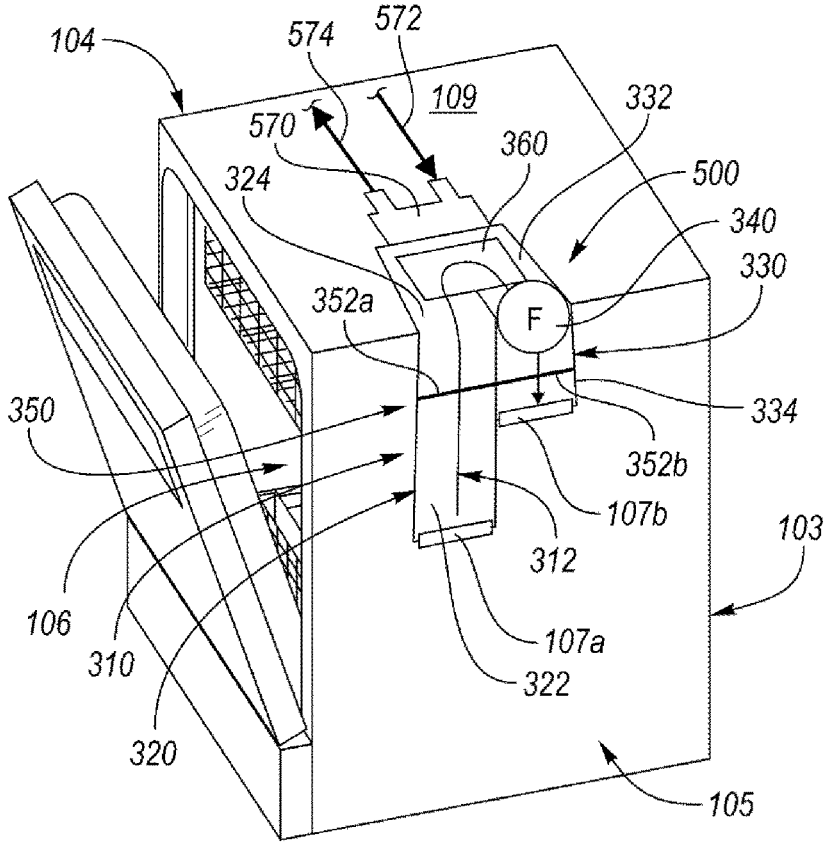
FIG. 5 is a schematic perspective view of a drying system of a dishwasher, according to yet another embodiment.

Referring to FIG. 5, the dishwasher 100 is shown with a drying system 500 according to yet another embodiment. The drying system 500 includes similar components as drying system 300 having an inverted V-shaped air circuit 310 with the adsorbent component 360 positioned against the tub top wall 109. The drying system 500 further includes cooling mechanism such as a cooler 570 corresponding to the adsorbent component 560. The cooler 570 is positioned adjacent the adsorbent component 360, and in contact with the walls of the air circuit 310 to cool the adsorbent material during the drying cycle such that the adsorption potential can be increased. Although a single coolers 570 is shown in FIG. 5, two or more coolers may be used as based on the desired design of the drying system 500. For example, in some embodiments, although not shown, a pair of coolers may be disposed on either side of the adsorbent component 360, with one on the inlet conduit 220 side and one on the outlet conduit 230 side. The cooler 570 is supplied with a coolant, such as water, which flows through the cooler 570 via coolant supply lines 572 and coolant outlet lines 574. The coolant may be any suitable temperature to enhance adsorption of the adsorbent material, and in some embodiments, may be about 15° C.

Figure 6:
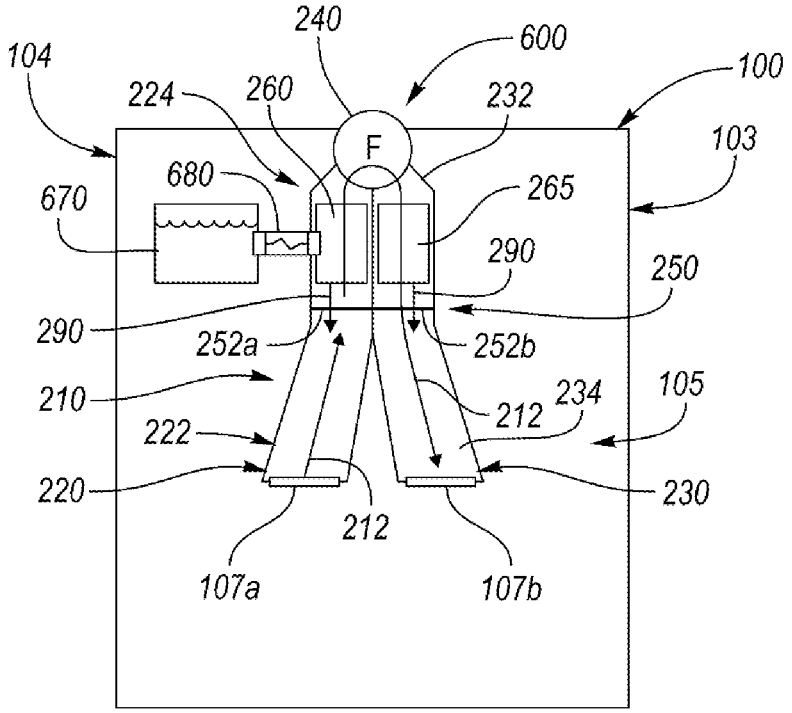
FIG. 6 is a schematic side view of a drying system of a dishwasher, according to yet another embodiment.

Referring to FIG. 6, the dishwasher 100 is shown with drying systems 600 respectively, according to yet other embodiments. FIG. 6 corresponds similarly to the drying system 200 of FIG. 2, and further include a water tank 670 for absorbing heat from the adsorbent material of the corresponding adsorbent component 260 to increase the adsorption potential of the adsorbent material during the drying cycle. Although only shown for the drying system 200, a similar arrangement of heat exchanger with a water tank is contemplated with the drying system 300. As shown in the example of FIG. 6, the water tank 670 may be positioned adjacent the adsorbent components 260 as discussed with respect to the coolers of FIGS. 4-5. The example shown in FIG. 6 further includes a heat exchanger 680 for transferring heat from the adsorbent material of the adsorbent components 260 to the water in the water tanks 670. Although one heat exchanger 680 is shown between the water tank 670 and the adsorbent component 260, any suitable number of heat exchangers 680 may be used as based on efficiently transferring heat from the adsorbent components 260, 265 to the water tank 670. The heat exchanger 680, 780 may be any suitable heat exchanger, including, but not limited to, heat exchange pipes. The heat transferred to the water tank 670 heats water therein which can be further used in the next wash cycle as the hot water for dish washing. In certain embodiments, the water may be held at, or heated to, ambient temperature (e.g., about 24° C.) from the normal supply of about 15° C. such that heating for the wash cycle requires less energy. As such, the wash and dry cycles result in more energy efficient operation for the dishwasher 100.

In at least one embodiment, a method of operating a dishwasher includes running a wash cycle to clean dishes loaded into a tub of the dishwasher, and initiating a dry cycle which supplies hot air to the tub to dry the dishes to form hot humid air. The method further includes upon initiating the dry cycle, opening a gate check valve to unblock airflow from entering conduits of the drying system, and flowing the hot humid air into a drying system to contact at least one adsorbent material positioned within a conduit of the drying system, with the adsorbent contacting at least one tub wall of the tub, and forming a dry air stream to be supplied back to the tub. During a subsequent wash cycle, the method includes regenerating the adsorbent material via heat transfer through the at least one tub wall such that expelled water from the adsorbent material is drained via the conduits of the drying system prior to a subsequent dry cycle. The tub wall which is contacted by the adsorbent may be a side wall of the tub, or a top wall of the tub. In certain embodiments, opening the gate check valve includes opening both a first gate in an inlet conduit of the conduits and a second gate in an outlet conduit of the conduits via a single actuator. In one or more embodiments, the method further includes cooling the adsorbent material during the dry cycle via a cooler contacting the conduits to increase an adsorption potential of the adsorbent material when compared to an uncooled adsorbent material.

According to one or more embodiments, a dishwasher includes a drying system having an adsorbent material configured to regenerate using heat from the tub during a wash cycle of the dishwasher. The adsorbent material may be positioned in an air circuit against the tub side wall or tub top wall, with the air circuit having a generally inverted V-shape such that water can drain via gravity during regeneration of the adsorbent material. As such, air is dehumidified by flowing through the air circuit via contact with the adsorbent material, and dry air can be returned to the tub to further facilitate drying. In certain embodiments, the adsorbent material is cooled during the drying cycle to increase adsorption potential of the adsorbent material.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

Except in the examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. As used herein, the term "about" means that the amount or value in question may be the specific value designated or some other value in its neighborhood. Generally, the term "about" denoting a certain value is intended to denote a range within +/−5% of the value. As one example, the phrase "about 100" denotes a range of 100+/−5, i.e. the range from 95 to 105. Generally, when the term "about" is used, it can be expected that similar results or effects according to the invention can be obtained within a range of +/−5% of the indicated value.

It should also be appreciated that integer ranges (e.g., for measurements or dimensions) explicitly include all intervening integers. For example, the integer range 1-10 explicitly includes 1, 2, 3, 4, 5, 6, 7, 8, 9, and 10. Similarly, the range 1 to 100 includes 1, 2, 3, 4, . . . 97, 98, 99, 100. Similarly, when any range is called for, intervening numbers that are increments of the difference between the upper limit and the lower limit divided by 10 can be taken as alternative upper or lower limits. For example, if the range is 1.1. to 2.1 the following numbers 1.2, 1.3, 1.4, 1.5, 1.6, 1.7, 1.8, 1.9, and 2.0 can be selected as lower or upper limits.

In the specific examples set forth herein, concentrations, temperature, and reaction conditions (e.g. pressure, pH, flow rates etc.) can be practiced with plus or minus 50 percent of the values of the examples indicated, rounded to or truncated to three significant figures. In a refinement, concentrations, temperature, and reaction conditions (e.g., pressure, pH, flow rates, etc.) can be practiced with plus or minus 30 percent of the values indicated rounded to three significant figures of the value provided in the examples. In another refinement, concentrations, temperature, and reaction conditions (e.g., pressure, pH, flow rates, etc.) can be practiced with plus or minus 10 percent of the values indicated rounded to three significant figures of the value provided in the examples.

It is also to be understood that this invention is not limited to the specific embodiments and methods described below, as specific components and/or conditions may, of course, vary. Furthermore, the terminology used herein is used only for the purpose of describing particular embodiments of the present invention and is not intended to be limiting in any way.

It must also be noted that, as used in the specification and the appended claims, the singular form "a," "an," and "the" comprise plural referents unless the context clearly indicates otherwise. For example, reference to a component in the singular is intended to comprise a plurality of components.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

What is claimed is:

1. A method of operating a dishwasher comprising:

running a wash cycle to clean dishes loaded into a tub;

initiating a dry cycle to supply hot air to the tub to dry the dishes thereby forming hot humidified air;

opening a gate check valve to permit the hot humidified air to enter a drying system;

flowing the hot humidified air into the drying system to contact at least one adsorbent material positioned within a conduit of the drying system and contacting at least one tub wall of the tub to absorb moisture from the hot humidified air to form a dry recirculating air stream for supply to the tub, the dry recirculating air stream having a humidity less than the hot humidified air; and during a subsequent wash cycle, regenerating the adsorbent material via heat transfer through the at least one tub wall such that expelled water from the adsorbent material is drained from the drying system prior to a subsequent dry cycle.

2. The method of claim 1, wherein flowing the hot humidified air into the drying system includes actuating a fan disposed in the drying system upon initiation of the dry cycle to facilitate air flow through the drying system.

3. The method of claim 1, wherein the tub wall is a side tub wall.

4. The method of claim 1, wherein the tub wall is a top tub wall.

5. The method of claim 1, wherein opening the gate check valve includes opening both a first gate in an inlet conduit of the conduit and a second gate in an outlet conduit of the conduit via a single actuator.

6. The method of claim 1, wherein the conduit defines an air circuit having an inverted V-shape, with an inlet conduit forming a first side of the inverted V-shape, and an outlet conduit forming a second side of the inverted V-shape.

7. The method of claim 6, wherein at least one of the inlet conduit and the outlet conduit drain water formed during regenerating of the adsorbent material by gravity to the tub.

8. The method of claim 6, wherein the opening of the gate check valve includes opening a first gate in the inlet conduit and a second gate in the outlet conduit, with both the first and second gates being actuated by a single actuator.

9. The method of claim 6, wherein each of the inlet conduit and the outlet conduit include a corresponding adsorbent component of the at least one adsorbent material positioned against the at least one tub wall.

10. The method of claim 1, further comprising:

cooling the at least one adsorbent material during the subsequent dry cycle via a cooler contacting the drying system to increase an adsorption potential of the at least one adsorbent material when compared to an uncooled adsorbent material.

11. A method of operating a dishwasher comprising:

initiating a dry cycle to supply hot air to a tub to dry dishes loaded therein, thereby forming hot humidified air;

opening a gate check valve to permit the hot humidified air to enter a drying system, the drying system including an inlet conduit fluidly connected to an outlet of the tub and an outlet conduit fluidly connected to an inlet of the tub, with the inlet conduit and the outlet conduit forming an inverted V-shaped air circuit defining an airflow path therethrough;

flowing the hot humidified air into the drying system to contact at least one adsorbent material positioned within the airflow path and contacting at least one tub wall of the tub to absorb moisture from the hot humidified air and form a dry recirculating air stream for supply to the tub, the dry recirculating air stream having a humidity less than the hot humidified air; and regenerating the adsorbent material via heat transfer through the at least one tub wall such that expelled water from the adsorbent material is drained from the drying system.

12. The method of claim 11, wherein the opening of the gate check valve includes opening a first gate in the inlet conduit and a second gate in the outlet conduit, with both the first and second gates being actuated by a single actuator.

13. The method of claim 11, wherein each of the inlet conduit and the outlet conduit include a corresponding adsorbent component of the at least one adsorbent material positioned against the at least one tub wall.

14. The method of claim 11, further comprising:

cooling the at least one adsorbent material during a subsequent dry cycle via a cooler contacting the drying system to increase an adsorption potential of the at least one adsorbent material when compared to an uncooled adsorbent material.

15. The method of claim 11, wherein flowing the hot humidified air into the drying system includes actuating a fan disposed in the drying system upon initiation of the dry cycle to facilitate air flow through the drying system.

16. The method of claim 15, wherein the fan is disposed at an apex of the inverted V-shaped air circuit.

17. A method of operating a dishwasher comprising:

initiating a dry cycle to supply hot air to a tub to dry dishes loaded therein, thereby forming hot humidified air;

opening a gate check valve to permit the hot humidified air to enter a drying system, the drying system including an inlet conduit fluidly connected to an outlet of the tub and an outlet conduit fluidly connected to an inlet of the tub, with the inlet conduit and the outlet conduit forming an air circuit defining an airflow path therethrough;

flowing the hot humidified air into the drying system to contact at least one adsorbent material positioned along the airflow path and contacting at least one tub wall of the tub to absorb moisture from the hot humid air and form a dry recirculating air stream for supply to the tub via the inlet, the dry recirculating air stream having a humidity less than the hot humidified air; and during a subsequent wash cycle, regenerating the adsorbent material via heat transfer through the at least one tub wall prior to a subsequent dry cycle.

18. The method of claim 17, wherein the dry recirculating air stream is supplied to the tub via the outlet conduit and the inlet of the tub.

19. The method of claim 17, further comprising:

draining water expelled from the at least one adsorbent material during regenerating from the drying system via the inlet conduit, the outlet conduit, or both.

20. The method of claim 17, further comprising:

cooling the at least one adsorbent material during the subsequent dry cycle via a cooler contacting the drying system to increase an adsorption potential of the at least one adsorbent material when compared to an uncooled adsorbent material.

* * * * *